US011920424B2

(12) United States Patent
Arsalan et al.

(10) Patent No.: US 11,920,424 B2
(45) Date of Patent: Mar. 5, 2024

(54) BOTTOMHOLE ASSEMBLY DEPLOYMENT

(71) Applicants: Saudi Arabian Oil Company, Dhahran (SA); WIRELESS INSTRUMENTATION SYSTEMS AS, Trondheim (NO)

(72) Inventors: Muhammad Arsalan, Dhahran (SA); Stian Marius Hansen, Trondheim (NO); Jarl André Fellinghaug, Trondheim (NO)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/548,796

(22) Filed: Dec. 13, 2021

(65) Prior Publication Data

US 2022/0098951 A1 Mar. 31, 2022

Related U.S. Application Data

(62) Division of application No. 16/537,947, filed on Aug. 12, 2019.

(60) Provisional application No. 62/718,053, filed on Aug. 13, 2018.

(51) Int. Cl.
*E21B 33/06* (2006.01)
*E21B 19/22* (2006.01)

(52) U.S. Cl.
CPC ..... *E21B 33/061* (2013.01); *E21B 19/22* (2013.01)

(58) Field of Classification Search
CPC ..... E21B 33/061; E21B 19/22
See application file for complete search history.

(56) References Cited

U.S. PATENT DOCUMENTS

| | | | | |
|---|---|---|---|---|
| 4,685,521 | A | 8/1987 | Raulins | |
| 5,215,151 | A | 6/1993 | Smith | |
| 5,503,228 | A | 4/1996 | Anderson | |
| 5,738,173 | A | 4/1998 | Burge | |
| 6,209,652 | B1 | 4/2001 | Portman et al. | |
| 6,609,571 | B2 * | 8/2003 | Nice | E21B 33/076 166/368 |
| 7,086,481 | B2 | 8/2006 | Hosie | |
| 7,347,261 | B2 | 3/2008 | Markel | |
| 7,410,003 | B2 | 8/2008 | Ravensbergen et al. | |
| 8,024,847 | B2 | 9/2011 | Beall | |
| 8,851,192 | B2 | 10/2014 | Deible | |
| 9,651,705 | B2 | 5/2017 | Wu et al. | |

(Continued)

FOREIGN PATENT DOCUMENTS

| | | |
|---|---|---|
| EP | 0380148 | 8/1990 |
| GB | 2218721 | 11/1989 |

(Continued)

OTHER PUBLICATIONS

GCC Examination Report in Gulf Cooperation Council Appln. No. GC 2019-38101, dated Sep. 3, 2020, 4 pages.

(Continued)

*Primary Examiner* — Aaron L Lembo
(74) *Attorney, Agent, or Firm* — Fish & Richardson P.C.

(57) ABSTRACT

A system including a bottom hole assembly and a ram positioned below a barrier of a well and methods for deploying the same are described. The ram is configured to secure the bottom hole assembly at an end of the bottom hole assembly to secure the bottom hole assembly within the well.

8 Claims, 17 Drawing Sheets

(56) References Cited

U.S. PATENT DOCUMENTS

| | | | |
|---|---|---|---|
| 9,903,172 | B2 | 2/2018 | Hansen |
| 10,724,312 | B2 | 7/2020 | Zsolt |
| 10,844,672 | B2 | 11/2020 | Dziekonski |
| 11,028,667 | B2 * | 6/2021 | Arsalan ..... E21B 47/06 |
| 2004/0026078 | A1 | 2/2004 | Norris |
| 2004/0134666 | A1 | 7/2004 | Orr et al. |
| 2005/0274527 | A1 | 12/2005 | Misselbrook |
| 2015/0073018 | A1 | 3/2015 | Bang-Anderson et al. |
| 2018/0155991 | A1 | 6/2018 | Arsalan |
| 2018/0274311 | A1 | 9/2018 | Zsolt |

FOREIGN PATENT DOCUMENTS

| | | |
|---|---|---|
| WO | WO 9306331 | 4/1993 |
| WO | WO 2015073018 | 5/2015 |
| WO | WO 2016130620 | 8/2016 |

OTHER PUBLICATIONS

GCC Examination Report in Gulf Cooperation Council Appln. No. GC 2019-38101, dated Mar. 29, 2021, 4 pages.

International Search Report and Written Opinion issued in International Application No. PCT/US2019/046271 dated Dec. 19, 2019, 15 pages.

EP Communication pursuant to Article 94(3) in European Appln. No. 19758871.8-1002, dated Jul. 6, 2022, 6 pages.

SAIP Examination Report in SAIP Appln. No. 521421230, dated Mar. 31, 2023, with English translation, 16 pages.

* cited by examiner

BOTTOMHOLE ASSEMBLY DEPLOYMENT

CROSS-REFERENCE TO RELATED APPLICATIONS

This application is a divisional of and claims priority to U.S. patent application Ser. No. 16/537,947, filed on Aug. 12, 2019, which in turn claims the benefit of U.S. Provisional Application Ser. No. 62/718,053, filed Aug. 13, 2018, the entire contents of which is incorporated by reference herein.

TECHNICAL FIELD

This disclosure relates to deployment of bottom hole assemblies, for example, in a well.

BACKGROUND

A bottom hole assembly is an assembly of equipment typically located at the bottom of a work string, wireline, or coiled tubing in a wellbore. Bottom hole assemblies can include a drill bit, a bit sub, a mud motor, stabilizers, drill collar, drillpipe, jarring devices, and crossovers for various threadforms. Some bottom hole assemblies include directional drilling and measuring equipment, measurement-while-drilling tools, logging-while-drilling tools, and other specialized devices. Simple bottom hole assemblies can be relatively inexpensive (for example, less than $100,000 USD), while complex bottom hole assemblies may cost ten or more times that amount.

SUMMARY

This disclosure describes technologies relating to deployment of bottom hole assemblies. Certain aspects of the subject matter described here can be implemented as a system including a bottom hole assembly and a ram positioned below a barrier of a well. The ram is configured to hold the bottom hole assembly at an end of the bottom hole assembly to secure the bottom hole assembly within the well.

This, and other aspects, can include one or more of the following features.

The bottom hole assembly can include multiple bottom hole assembly modules configured to be coupled to each other end-to-end independent of rotational movement.

The bottom hole assembly can be configured to be installed within the well one bottom hole assembly module at a time.

Each bottom hole assembly module can include an end configured to reversibly couple to a setting tool. The setting tool can be configured to position each of the bottom hole assembly modules within the well.

The bottom hole assembly can have a longitudinal length greater than 100 feet (for example, hundreds of feet or thousands of feet).

At least a portion of the bottom hole assembly can be hollow.

The bottom hole assembly can be hollow.

Certain aspects of the subject matter described here can be implemented as a method for deploying a bottom hole assembly within a well. A bottom hole assembly is coupled to a setting tool. The bottom hole assembly is positioned within a lubricator. The lubricator, within which the bottom hole assembly is positioned, is installed on the well. After installing the lubricator, a barrier of the well is opened. With the setting tool, the bottom hole assembly is positioned downhole through the open barrier. The bottom hole assembly is secured with a ram positioned below the barrier to secure the bottom hole assembly within the well. The bottom hole assembly is decoupled from the setting tool. The barrier is closed. The lubricator is uninstalled from the well.

This, and other aspects, can include one or more of the following features.

The bottom hole assembly can include multiple bottom hole assembly modules configured to be coupled to each other end-to-end independent of rotational movement.

The method can be repeated on each of the bottom hole assembly modules.

The bottom hole assembly modules can be coupled to each other end-to-end to form the bottom hole assembly.

The bottom hole assembly can have a longitudinal length greater than 100 feet.

One or more of the bottom hole assembly modules can be hollow.

At least a portion of the bottom hole assembly can be hollow.

Certain aspects of the subject matter described here can be implemented as a method. A first module is secured at an uphole end of the first module with a ram positioned below a barrier of a well to secure the first module within the well. The uphole end of the first module is coupled to a downhole end of a second module. The first module (coupled to the second module) is released from the ram. The second module is secured at an uphole end of the second module with the ram to secure the second module (coupled to the first module) within the well.

This, and other aspects, can include one or more of the following features.

Coupling the uphole end of the first module to the downhole end of the second module can be accomplished independent of rotational movement of the first module and the second module.

The first module can be coupled to a setting tool. The first module can be positioned within a lubricator. The lubricator, within which the first module is positioned, can be installed on the well. After installing the lubricator, the barrier can be opened. With the setting tool, the first module can be positioned downhole through the open barrier. After securing the first module with the ram, the first module can be decoupled from the setting tool. The barrier can be closed. The lubricator can be uninstalled from the well.

The second module can be coupled to the setting tool. The second module can be positioned within the lubricator. The lubricator, within which the second module is positioned, can be installed on the well. After installing the lubricator (within which the second module is positioned), the barrier can be opened. With the setting tool, the second module can be positioned downhole through the open barrier. After securing the second module with the ram, the second module can be decoupled from the setting tool.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

Figure 1A:
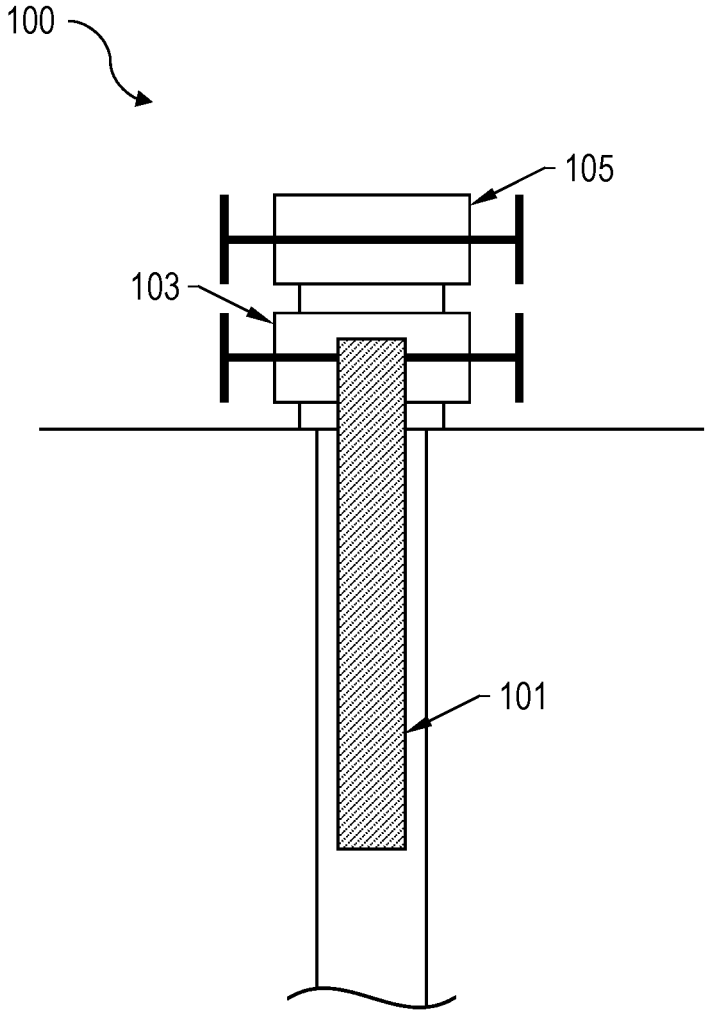
FIGS. 1A and 1B are a schematic diagrams of example systems.

This disclosure describes deployment of bottom hole assemblies, for example, in a well (such as a hydrocarbon well), in accordance with some implementations of the present disclosure. Deploying long bottom hole assemblies can be challenging due to various limitations, such as rig up height and length of the lubricator. Long bottom hole assemblies are those that are longer (in longitudinal length) than conventional lubricators. Long bottom hole assemblies typically require specialized equipment and methods to provide the necessary pressure envelope of the well barrier.

Bottom hole assemblies can include a variety of equipment depending on the application, such as subs, pipe, pup joints, sand screens, packers, latches, flow control devices, and completions equipment. To install bottom hole assemblies in a well, a pressure envelope is maintained to confine the pressurized wellbore fluids from the surrounding environment. Typical light rig up methods for such pressure control involve the use of a blowout preventer, isolation valves, and a lubricator, in which the bottom hole assemblies are lubricated into the pressurized wellbore. Larger rig ups (for example, workover rigs) which also can involve killing the well (that is equalizing the well pressure with weight) with weighted mud can be used, but they are typically less desirable due to the increased cost, time, and complexity in comparison to light rig ups. The downside of using light rig ups, however, is that the lubricator imposes a finite limit to the length of the bottom hole assembly, as the bottom hole assembly cannot be longer than the lubricator itself when the bottom hole assembly is run into the wellbore. Commonly available lubricators are typically 30 feet to 60 feet in length with some having lengths up to 90 feet. In some cases, it can be desirable to install bottom hole assemblies that span several hundreds, if not thousands, of feet in a wellbore.

The subject matter described in this disclosure can be implemented in particular implementations, so as to realize one or more of the following advantages. A conventional lubricator can be used to deploy long bottom hole assemblies without killing a well, compromising the pressure envelope (also referred as the well barrier envelope), or both. This can be accomplished by separating the long bottom hole assembly into sections, which can be assembled together in the well to form the long bottom hole assembly. The methods described here can be implemented with conventional wireline or coiled tubing equipment. The methods described here can, in some implementations, ensure maintenance of an intact pressure envelope during the entirety of the bottom hole assembly process and deployment operation. The bottom hole assembly can be assembled together directly below the barrier of a well in modular format before the full-size long bottom hole assembly is deployed to a target depth within the wellbore, thereby avoiding excessive runs and time-consuming deployment associated with building the entire bottom hole assembly at the target depth. The modules of the bottom hole assembly can be coupled to each other (forming the full bottom hole assembly) without requiring rotational movement. For example, the modules of the bottom hole assembly can be coupled to each other with a push-pull latch and seal system. This is in contrast to the use of threaded connections, which requires the use of one or more specialized tools (and therefore complicates the connecting operation) to rotate one component and secure the other under pressure in order to couple the threaded connections together. Assembling and coupling the bottom hole assembly directly below the barrier (for example, in narrow tubing and in a vertical position) can allow for quick and less risky assembly of the bottom hole assembly in comparison to assembling the bottom hole assembly at the target depth within the wellbore which can, in some cases, be deviated or horizontal. Furthermore, in order to assemble modules at target depth, longer conveyance distances need to be covered, which can result in increased operational time, as well as increased risk of failure. In the case of an assembly failure, disassembling the bottom hole assembly can also be easier and quicker due to being located directly below the well barrier in comparison to bottom hole assemblies that are assembled further downhole, deep within the well.

FIG. 1A is a schematic diagram of a system 100, according to some implementations. The system 100 includes a bottom hole assembly 101 and a ram 103 positioned below a barrier 105 of a well formed in a subterranean zone. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other suitable types of formations, including reservoirs that are not naturally fractured in any significant amount.

The ram 103 is a type of sealing element. In some implementations, the ram 103 includes two portions manufactured to mate with one another to form a seal. For example, the ram 103 can be a pipe ram or a slip ram. Each of the portions can define a half-circle, such that a complete, circular hole is defined by the two portions when they are mated with one another. The whole formed by the two portions can be sized to fit around the bottom hole assembly 101. In some implementations, the ram 103 fits only one size or a small range of bottom hole assembly 101 sizes. In some implementations, the ram 103 is a variable bore pipe ram, which is designed and manufactured to properly seal on a wider range of bottom hole assembly 101 sizes. The ram 103 is configured to hold (that is, secure) the bottom hole assembly 101. The ram 103 can secure the bottom hole assembly 101 at an uphole end of the bottom hole assembly 101 to secure the bottom hole assembly 101 within the well. In some implementations, the bottom hole assembly 101 includes multiple bottom hole assembly modules (for example, the bottom hole assembly modules 101*a* and 101*b* shown in FIGS. 5A-5E) which can be coupled to each other end-to-end. In such cases, the bottom hole assembly 101 can be installed within the well, one bottom hole assembly module at a time.

In some implementations, at least a portion of the bottom hole assembly 101 is hollow (for example, tubular). For example, one or more of the bottom hole assembly modules (for example, bottom hole assembly module 101*a*, bottom hole assembly module 101*b*, or both) are hollow. In some implementations, the full bottom hole assembly 101 is hollow.

The barrier 105 is a valve located at the top of the well. The barrier 105 can be closed in the case that control of formation fluids is lost, so that control of the reservoir can be regained. Procedures can be initiated to increase mud density until the barrier 105 can be opened and retain pressure control of the formation. The barrier 105 can be of any style and can have any size and pressure rating considered suitable for the well on which the barrier 105 is installed. Some non-limiting examples of the barrier 105 include a blowout preventer, a crown valve, or a flow valve.

Figure 1B:
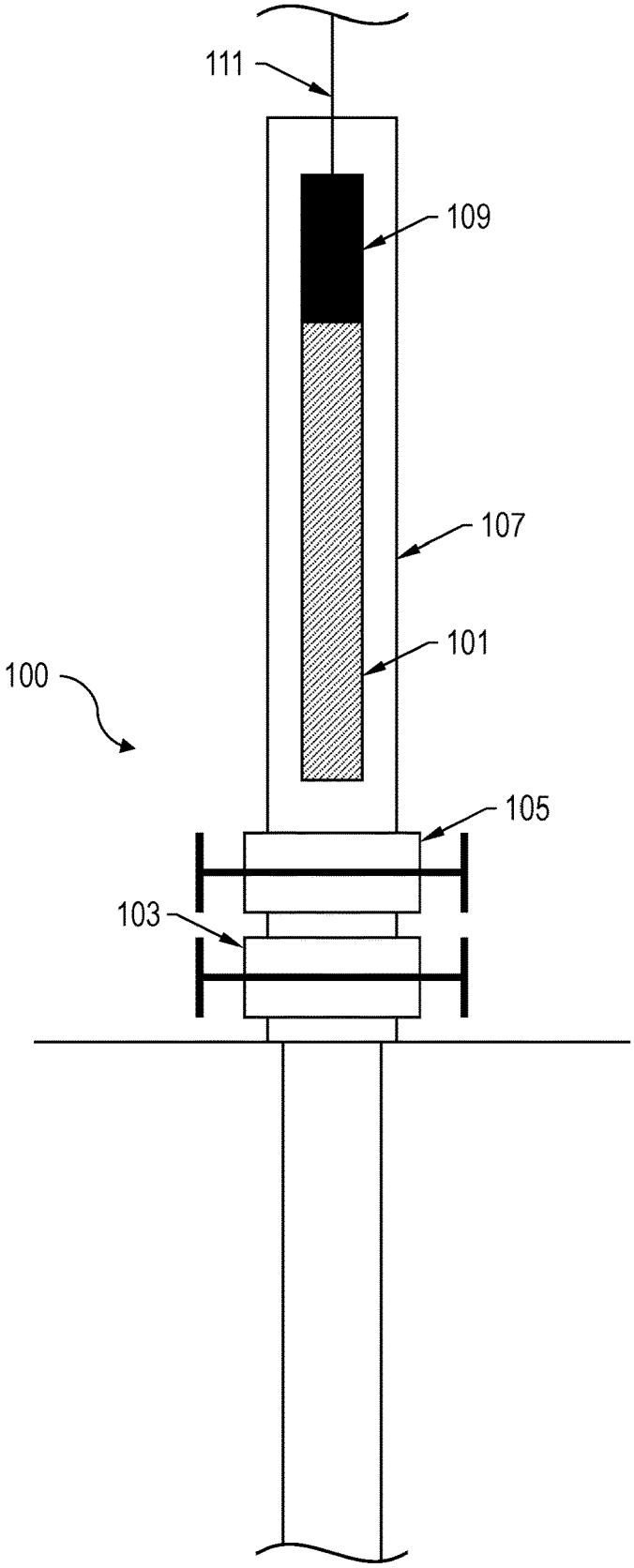

FIG. 1B is a schematic diagram of the system 100, according to some implementations. The system 100 can include a lubricator 107, a setting tool 109, and a connection 111 to lift the bottom hole assembly 101. The lubricator 107 is a pressure vessel that can be installed on the top of a wellhead or Christmas tree (for example, on top of the barrier 105), so that tools (such as the bottom hole assembly 101) can be installed within the well while pressure control is maintained. The lubricator 107 can include a grease-injection section and sealing elements. One or more tools can be positioned within the lubricator 107, and the lubricator 107 can be pressurized (for example, by flowing fluid into the lubricator 107) to match the pressure of the wellbore. When the pressures are equalized, the barrier 105 can be opened, so that the tool(s) positioned within the lubricator 107 can be lowered into the wellbore. To remove tools, the reverse process can be followed: the tools to be removed can be pulled up into the lubricator 107 (under wellbore pressure), the barrier 105 can then be closed, and then the pressure within the lubricator 107 can be bled off (that is, relieved), so that the tools can be removed from within the lubricator 107.

The setting tool 109 (also referred as a running tool) is a tool or device that can be used to place or set an equipment (such as permanent packers, plugs, or the bottom hole assembly 101) within the well. In some implementations, the setting tool 109 can be used to retrieve equipment that has been set within the well. The setting tool 109 can be used to position the bottom hole assembly 101 within the well. The bottom hole assembly 101 has an end that can reversibly couple to (that is, capable of coupling to and decoupling from) the setting tool 109. In cases where the bottom hole assembly 101 is made of multiple bottom hole assembly modules, each of the bottom hole assembly modules has an end that can reversibly couple to the setting tool 109.

The connection 111 can be a wireline, cable, or tubing and connected to the setting tool 109. The connection 111 in conjunction with the setting tool 109 can be used to lower tools into the well. In some implementations, the connection 111 is a wireline. In some implementations, the connection 111 is coiled tubing. In some implementations, a well tractor is included with the connection 111. The type of connection 111 used can depend on various factors, such as the length of the bottom hole assembly 101, the weight of the bottom hole assembly 101, and the condition of the well (or portion of the well) within which the bottom hole assembly 101 is to be deployed. For example, if the bottom hole assembly 101 is to be placed in a horizontal or deviated portion of the well, a well tractor can be used with the connection 111.

Figure 2:
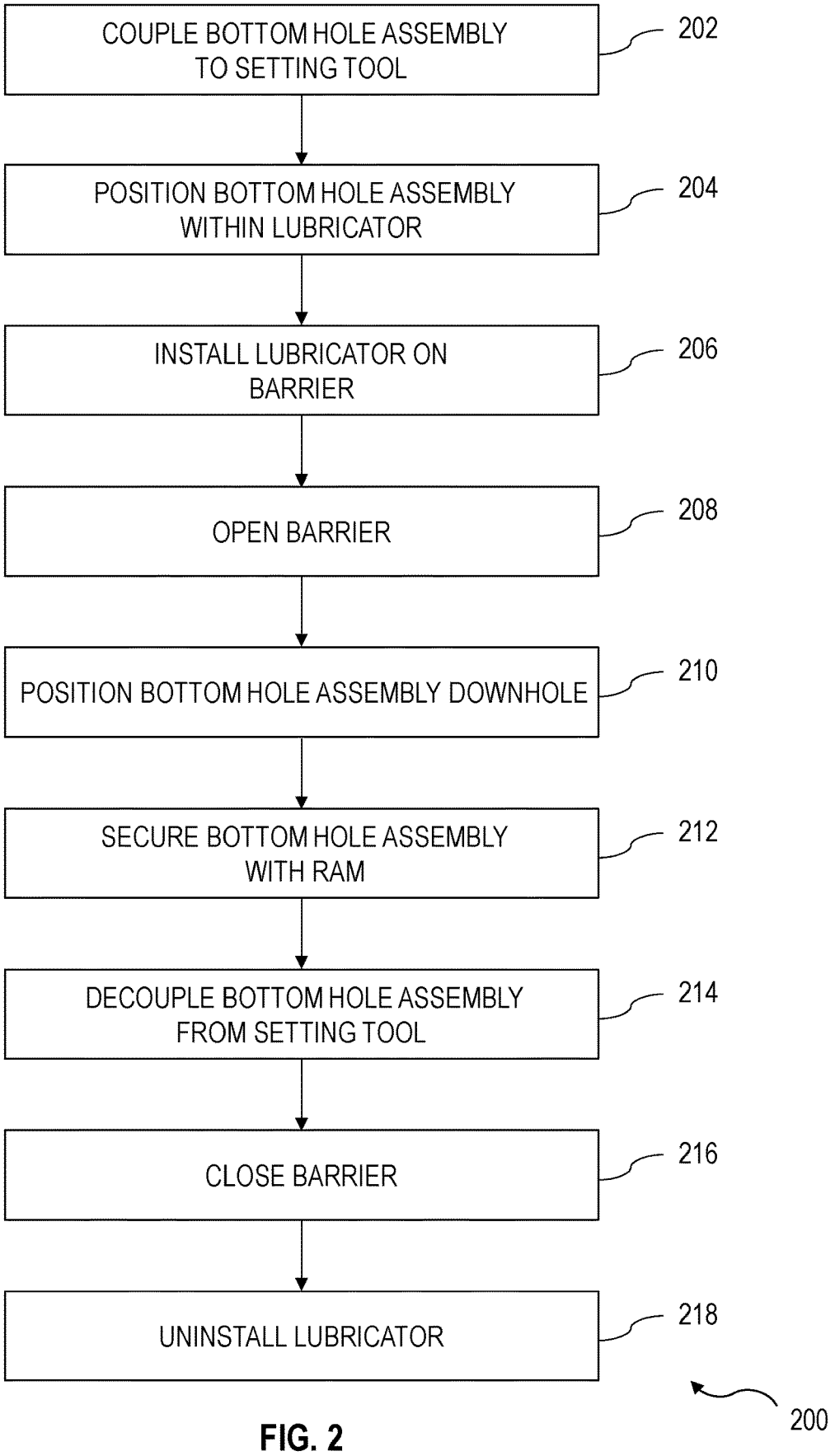
FIG. 2 is a flow chart of an example method for deploying a bottom hole assembly.
Figure 3A:
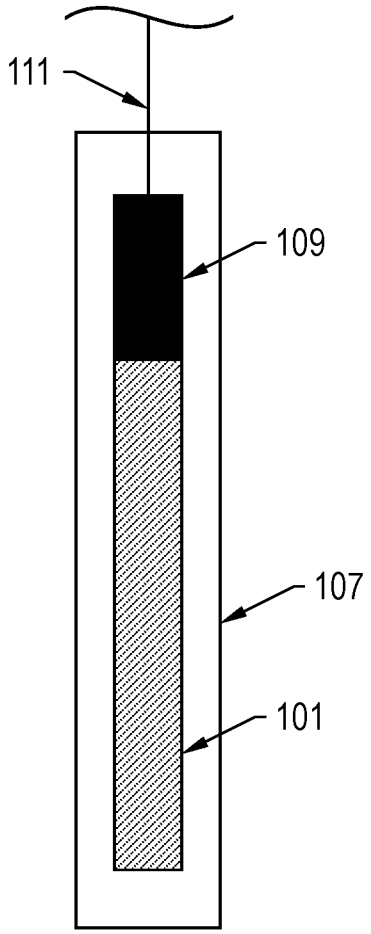
FIGS. 3A, 3B, 3C, 3D, 3E, 3F, 3G, and 3H are schematic diagrams illustrating a progression of the method of FIG. 2.
Figure 3B:
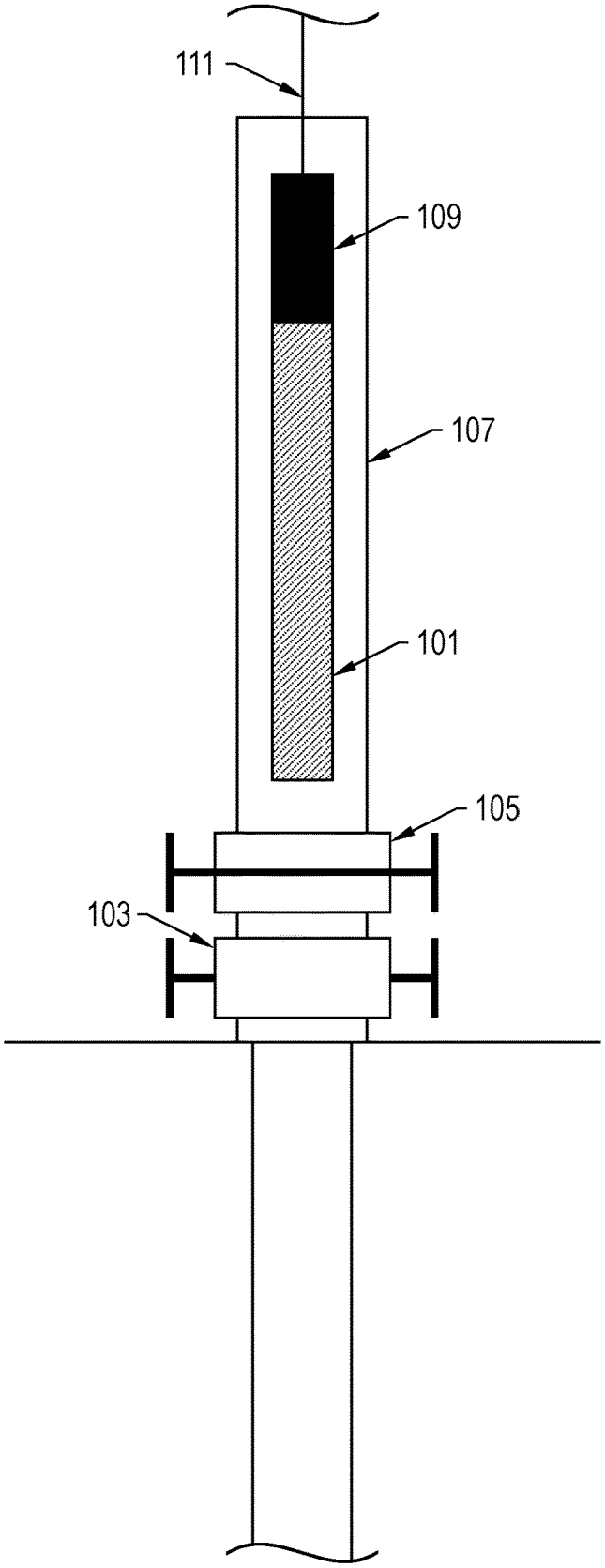
Figure 3C:
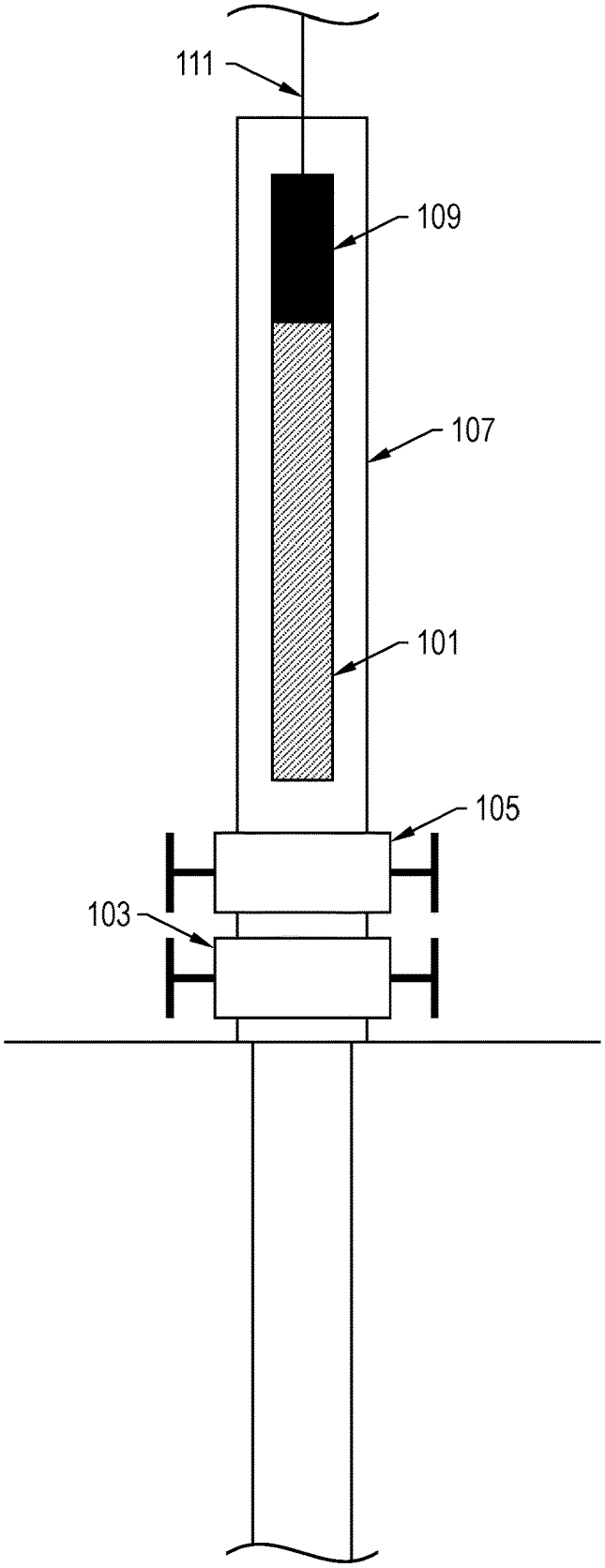
Figure 3D:
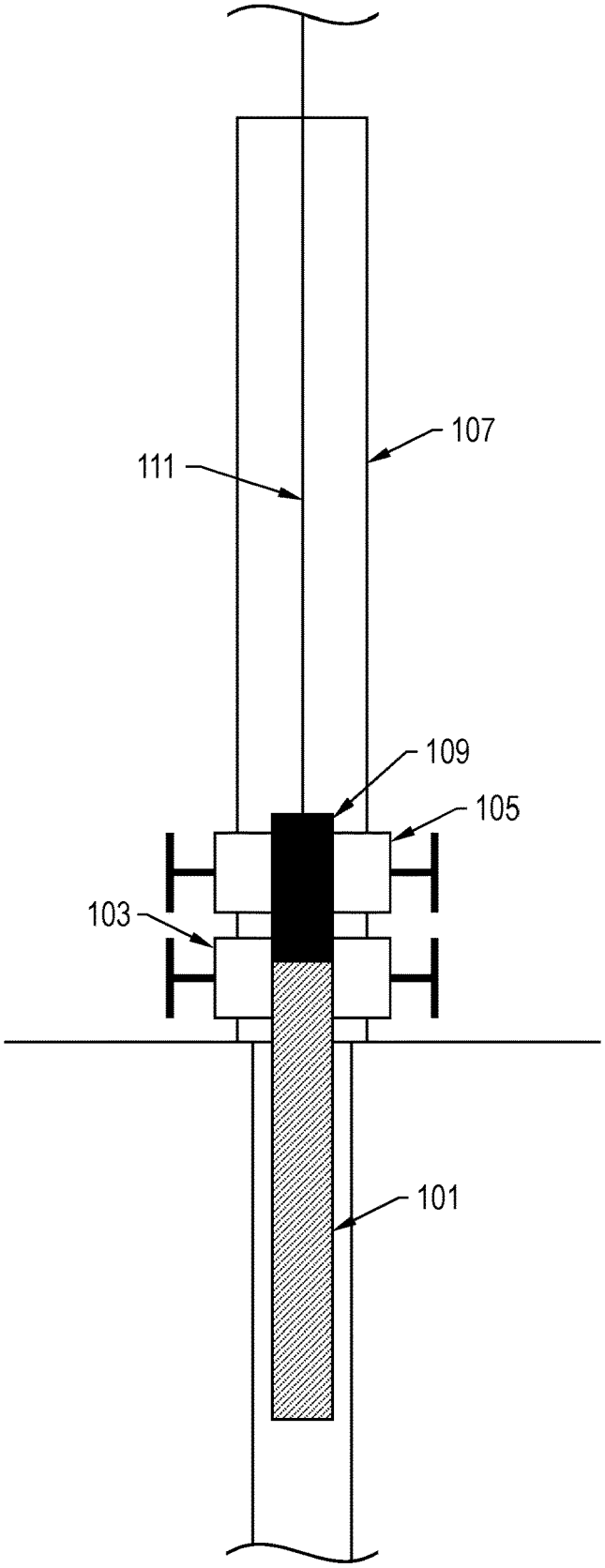
Figure 3E:
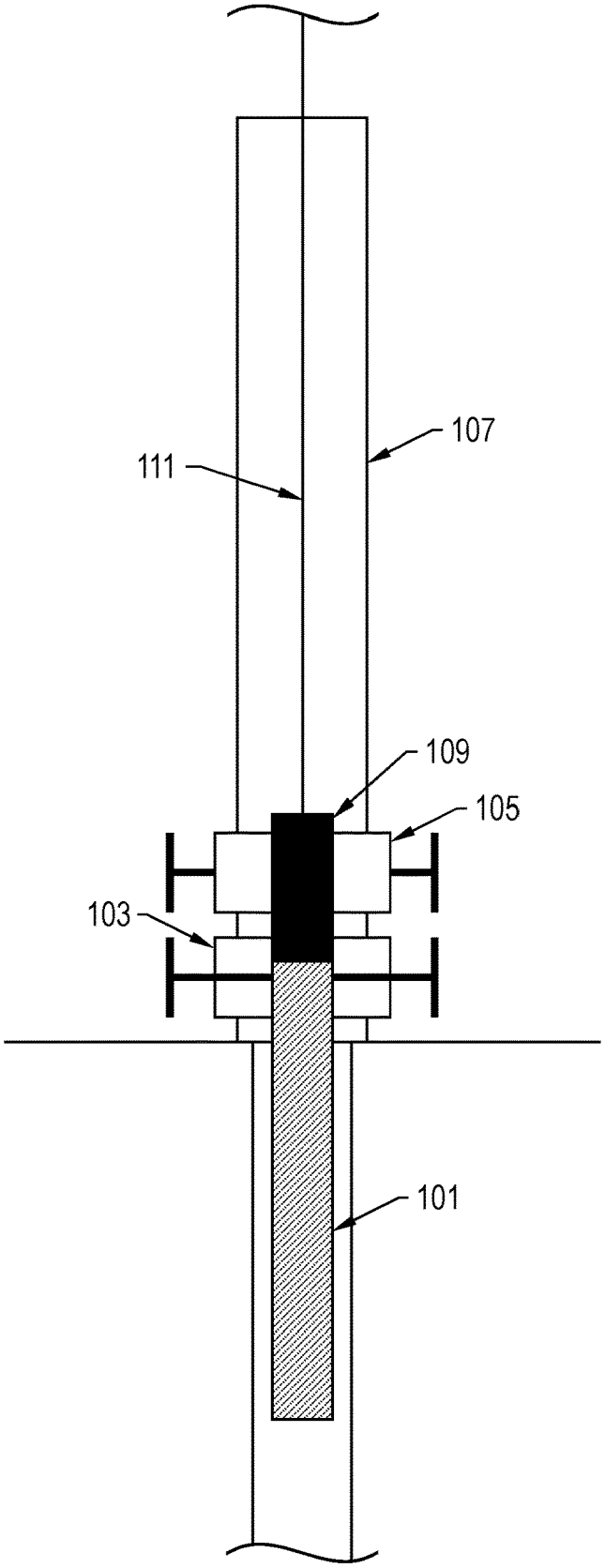
Figure 3F:
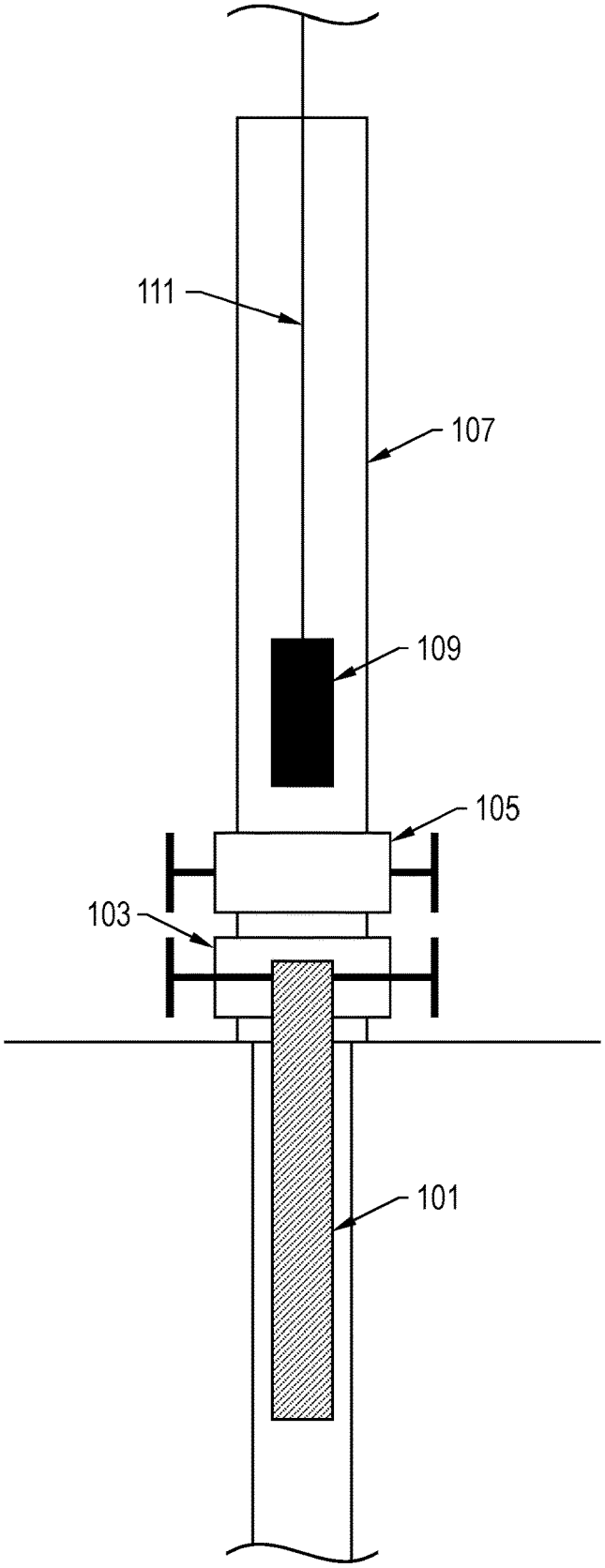
Figure 3G:
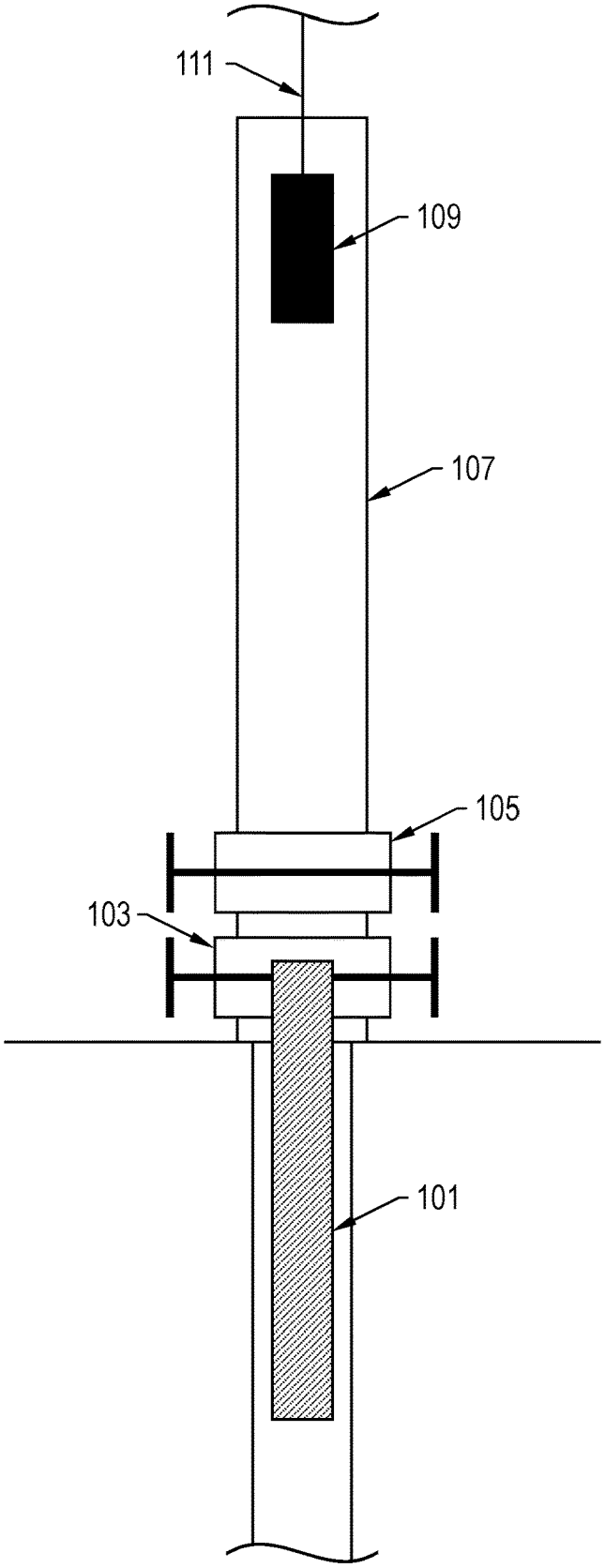
Figure 3H:
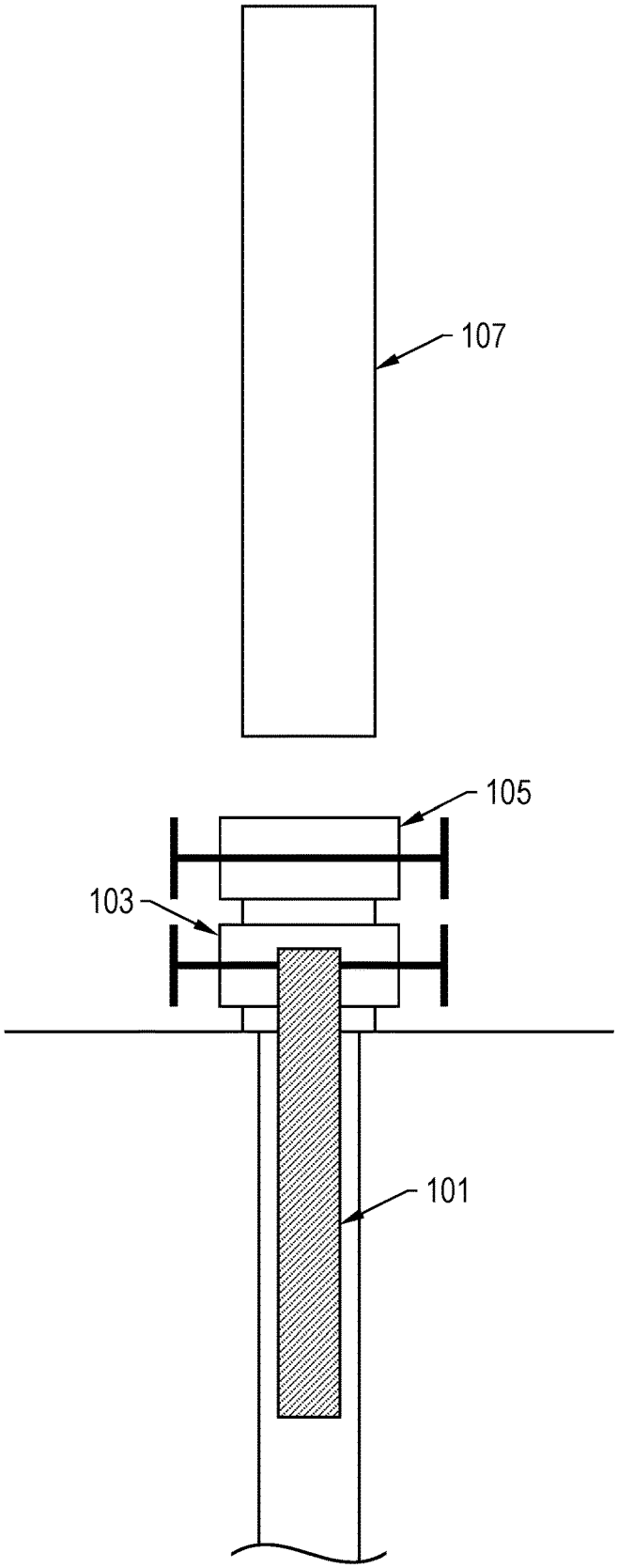

FIG. 2 is a flow chart of an example deployment method 200 for deploying a bottom hole assembly (such as the bottom hole assembly 101) within a well. The deployment method 200 can be applicable, for example, to the system 100. FIGS. 3A-3H illustrate a progression of the method 200. At step 202, the bottom hole assembly 101 is coupled to a setting tool (such as the setting tool 109 hanging from the connection 111). At step 204, the bottom hole assembly 101 is positioned within a lubricator (such as the lubricator 107). As shown in FIG. 3A, the setting tool 109 coupled to the bottom hole assembly 101 can be positioned within the lubricator 107. At step 206, the lubricator 107 (within which the bottom hole assembly 101 is positioned) is installed on the well, as shown in FIG. 3B. The lubricator 107 can then be pressurized to the pressure of the wellbore. After pressurizing the lubricator 107, a barrier of the well (such as the barrier 105) is opened at step 208, as shown in FIG. 3C. At step 210, the setting tool 109 can be used to position the bottom hole assembly 101 downhole through the open barrier 105, as shown in FIG. 3D. The bottom hole assembly 101 can be positioned at a desired depth within the well. At step 212, the ram 103 (positioned below the barrier 105) is used to hold the bottom hole assembly 101 to secure the bottom hole assembly 101 at the desired depth within the well, as shown in FIG. 3E. The ram 103 can be engaged (for example, closed around the bottom hole assembly 101) to hold and secure the bottom hole assembly 101 in place within the well. At step 214, the bottom hole assembly 101 is decoupled from the setting tool 109. The setting tool 109 can then be lifted or otherwise re-positioned within the lubricator 107, as shown in FIG. 3F. At step 216, the barrier 105 is closed, as shown in FIG. 3G. The pressure within the lubricator 107 can then be relieved, so that the setting tool 109 can be removed from the lubricator 107. At step 218, the lubricator 107 is uninstalled from the well, as shown in FIG. 3H. In cases where the bottom hole assembly 101 is made of multiple bottom hole assembly modules, the deployment method 200 can be repeated for each module (including coupling the modules together to form the full bottom hole assembly). In cases where a well tractor assembly is used, and the well tractor is too long to be installed together with the bottom hole assembly 101, the well tractor assembly can be installed separately after the full bottom hole assembly 101 is assembled by repeating the deployment method 200 on the well tractor assembly.

Figure 4:
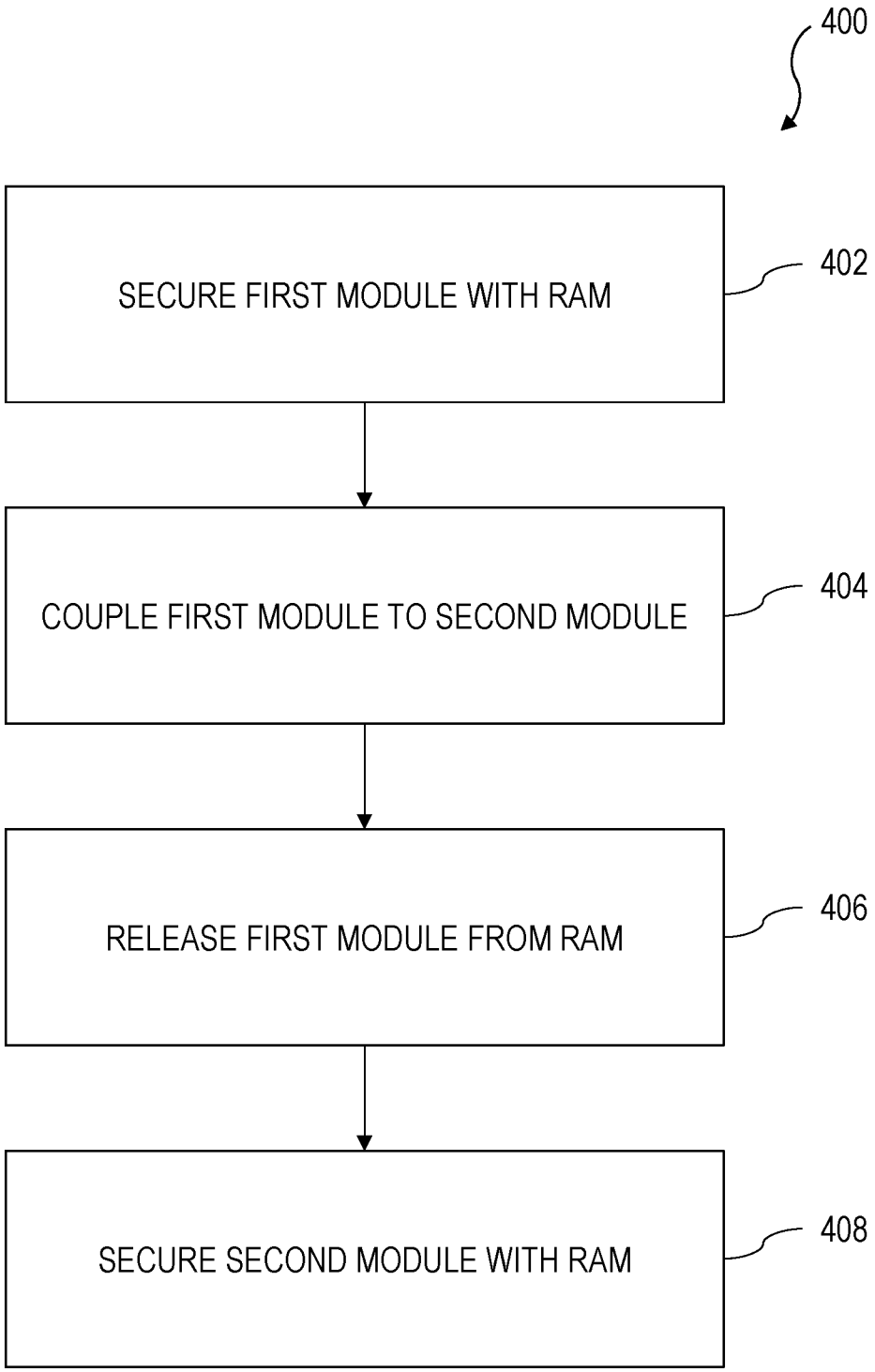
FIG. 4 is a flow chart of an example method for deploying modules within a well.
Figure 5A:
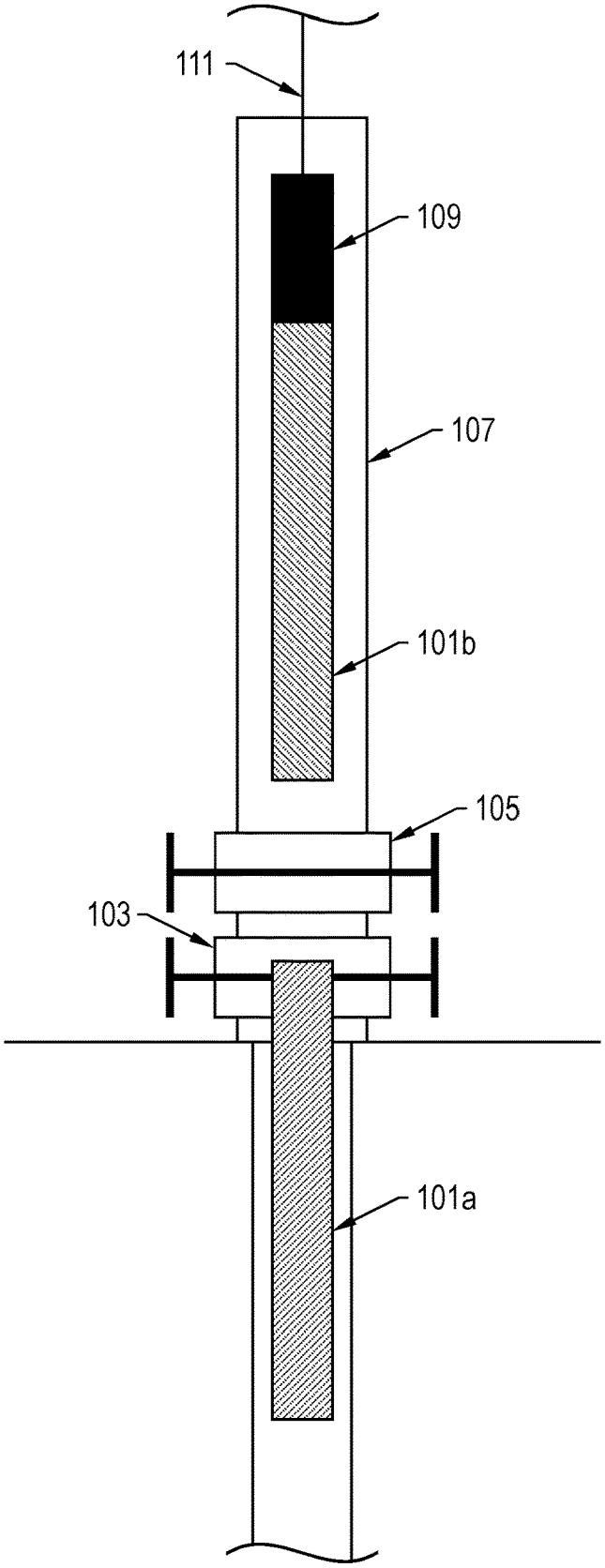
FIGS. 5A, 5B, 5C, 5D, and 5E are schematic diagrams illustrating a progression of the method of FIG. 4.
Figure 5B:
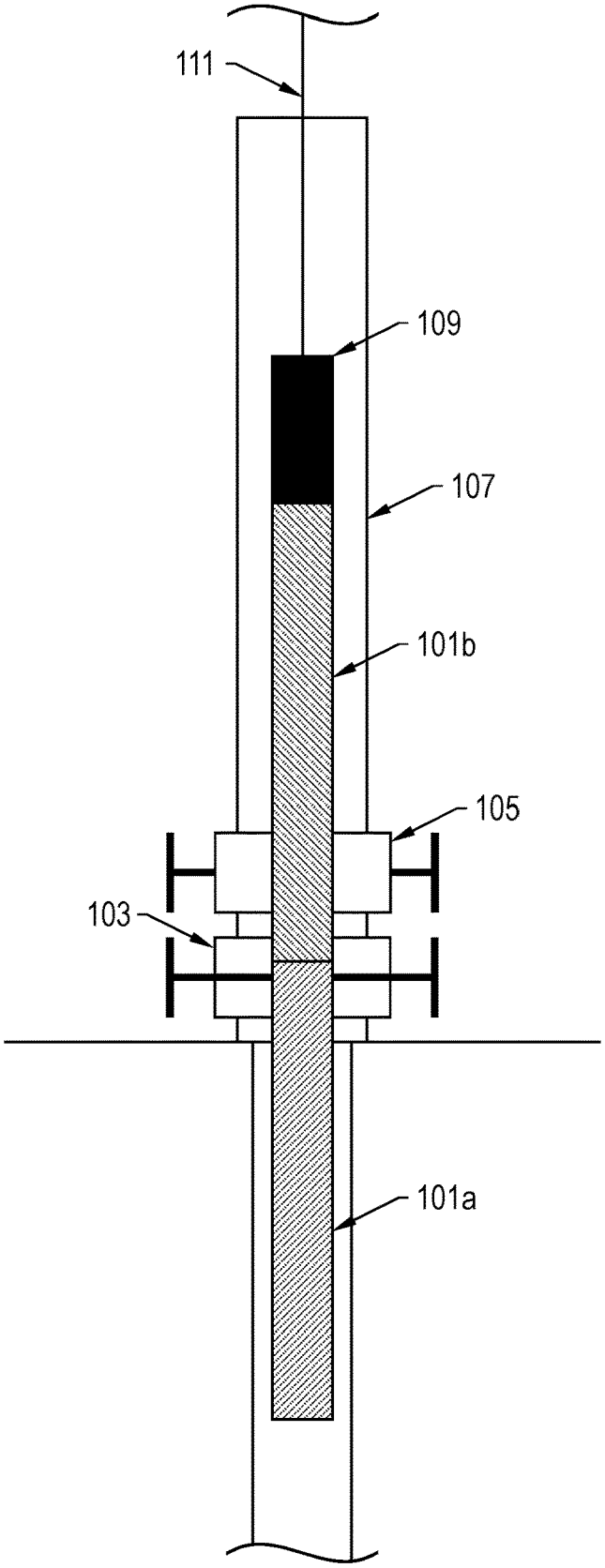
Figure 5C:
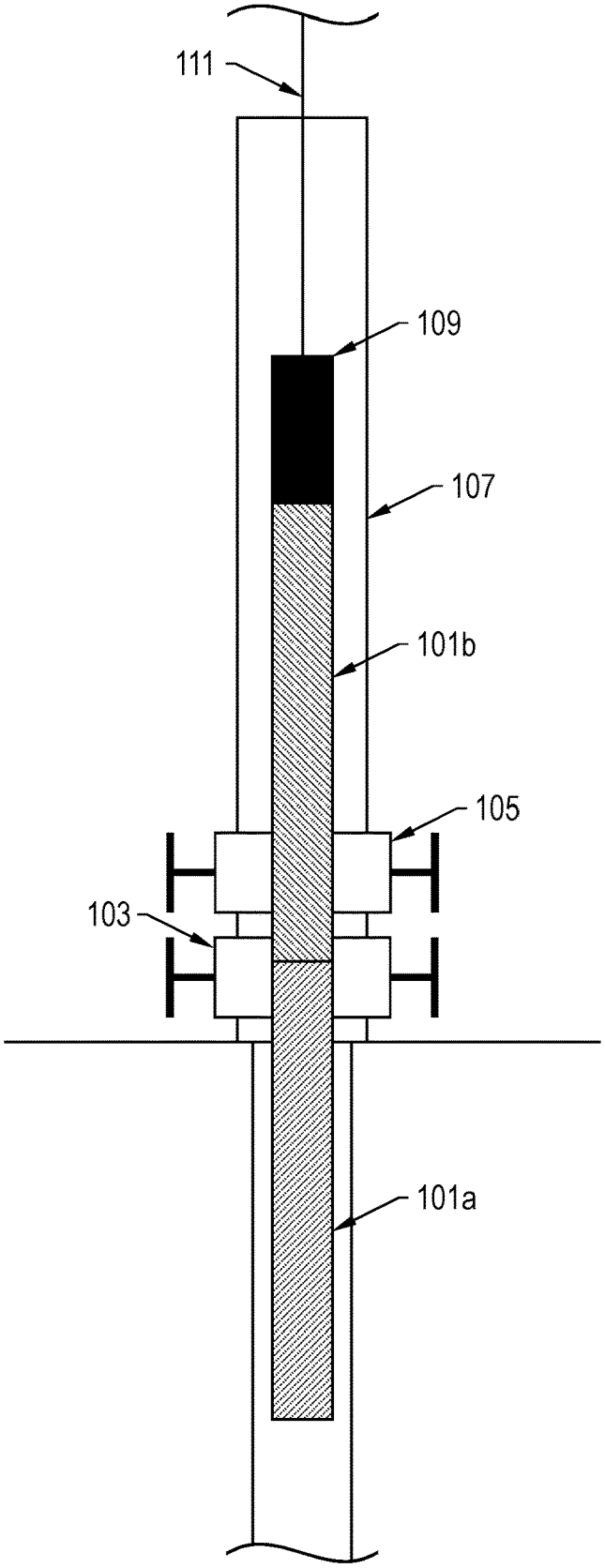
Figure 5D:
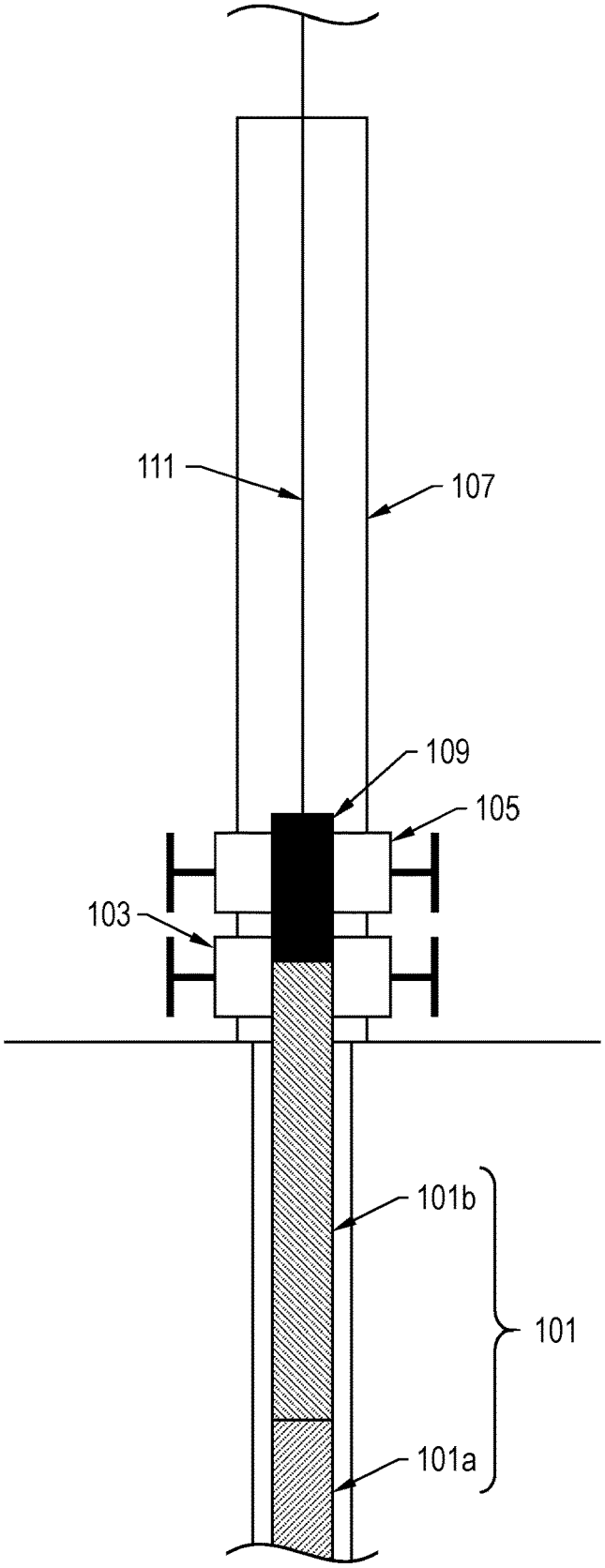
Figure 5E:
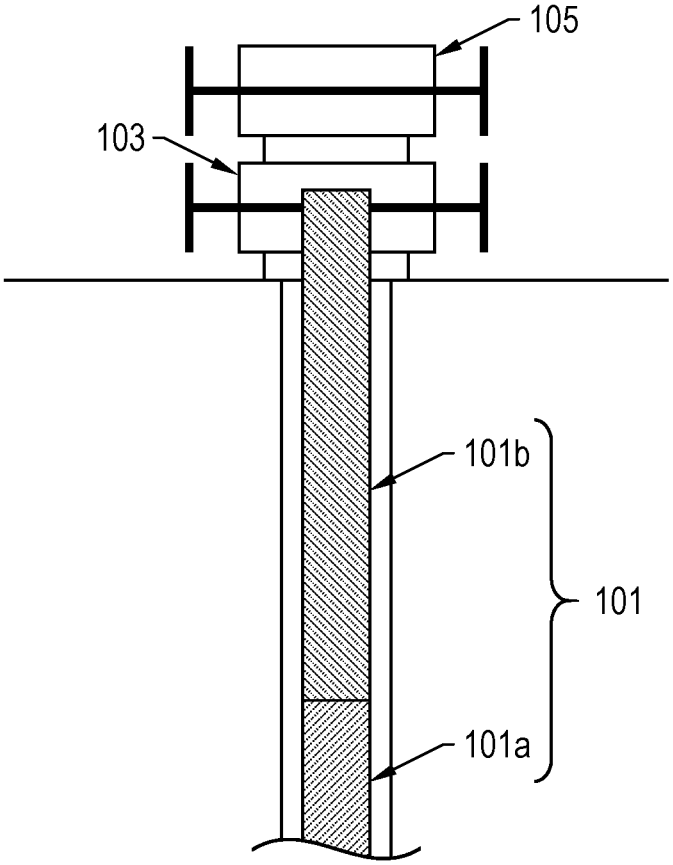

FIG. 4 is a flow chart of an example method 400 for deploying modules (for example, bottom hole assembly modules) within a well. The method 400 can be applicable, for example, to the system 100. FIGS. 5A-5E illustrate a progression of the method 400. At step 402, a first module (for example, a first bottom hole assembly module 101*a*) is secured at an uphole end of the first module 101*a* with a ram (for example, the ram 103 positioned below the barrier 105) to secure the first module 101*a* within a well. The first module 101*a* can be deployed within the well, for example, according to the deployment method 200. As shown in FIG. 5A, a second module (for example, a second bottom hole assembly module 101*b*) can be coupled to a setting tool (such as the setting tool 109 hanging from the connection 111) and positioned within a lubricator (such as the lubricator 107). The lubricator 107 (within which the second module 101*b* is positioned) can be installed on the well (for example, on the barrier 105), the lubricator 107 can be pressurized, and the barrier 105 can be opened in preparation for the following step 404. At step 404, the uphole end of the first module 101*a* is coupled to a downhole end of the second module 101*b*, as shown in FIG. 5B. In some implementations, coupling the uphole end of the first module 101*a* to the downhole end of the second module 101*b* does not require rotational movement of the first module 101*a* and the second module 101*b*. At step 406, the first module 101*a* (coupled to the second module 101*b*) is released from the ram 103, as shown in FIG. 5C. The setting tool 109 can be used to position the bottom hole assembly 101 (the bottom hole assembly modules 101*a* and 101*b* coupled together) downhole through the open barrier 105, as shown in FIG. 5D. The bottom hole assembly 101 can be positioned at a desired depth within the well. At step 408, the second module 101*b* is secured at an uphole end of the second module 101*b* with the ram 103 to secure the second module 101*b* (coupled to the first module 101*a*) within the well, as shown in FIG. 5E. The second module 101*b* can be decoupled from the setting tool 109. The setting tool 109 can then be lifted or otherwise re-positioned within the lubricator 107, the barrier 105 can be closed, and the pressure within the lubricator 107 can be relieved, so that the setting tool 109 can be removed from the lubricator 107. The lubricator 107 can then be uninstalled from the well. The method 400 can be repeated for additional modules (for example, a third bottom hole assembly module, a fourth bottom hole assembly module, and so on) until the entire bottom hole assembly 101 is assembled (formed by the modules coupled to each other).

In this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

In this disclosure, "approximately" means a deviation or allowance of up to 10 percent (%) and any variation from a mentioned value is within the tolerance limits of any machinery used to manufacture the part.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise. "About" can allow for a degree of variability in a value or range, for example, within 10%, within 5%, or within 1% of a stated value or of a stated limit of a range.

While this disclosure contains many specific implementation details, these should not be construed as limitations on the scope of the subject matter or on the scope of what may be claimed, but rather as descriptions of features that may be specific to particular implementations. Certain features that are described in this disclosure in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results.

Accordingly, the previously described example implementations do not define or constrain this disclosure. Other changes, substitutions, and alterations are also possible without departing from the spirit and scope of this disclosure.

What is claimed is:

1. A method for deploying a bottom hole assembly within a well, the method comprising:

coupling a first bottom hole assembly module to a setting tool;

positioning the first bottom hole assembly module within a lubricator having a longitudinal length of up to 90 feet;

installing the lubricator, within which the first bottom hole assembly module is positioned, on the well;

after installing the lubricator, opening a barrier of the well;

positioning, with the setting tool, the first bottom hole assembly module downhole through the open barrier;

securing, with a ram positioned below the barrier, the first bottom hole assembly module to secure the first bottom hole assembly module within the well;

decoupling the first bottom hole assembly module from the setting tool;

closing the barrier;

uninstalling the lubricator from the well;

coupling a second bottom hole assembly module to the setting tool;

after uninstalling the lubricator, positioning the second bottom hole assembly module within the lubricator;

installing the lubricator, within which the second bottom hole assembly module is positioned, on the well;

after installing the lubricator, within which the second bottom hole assembly is positioned, opening the barrier of the well;

positioning, with the setting tool, the second bottom hole assembly module downhole through the open barrier;

coupling the second bottom hole assembly to the first bottom hole assembly module to form the bottom hole assembly, wherein the bottom hole assembly has a longitudinal length of greater than 100 feet, which is longer than the longitudinal length of the lubricator;

opening the ram to release the first bottom hole assembly;

lowering, with the setting tool, the bottom hole assembly, such that the second bottom hole assembly module is aligned for securing by the ram positioned below the barrier; and securing, with the ram, the second bottom hole assembly module to secure the bottom hole assembly within the well;

decoupling the second bottom hole assembly module from the setting tool; and closing the barrier.

2. The method of claim 1, wherein the second bottom hole assembly module is coupled to the first bottom hole assembly module end-to-end independent of rotational movement.

3. The method of claim 2, wherein at least one of the first bottom hole assembly module or the second bottom hole assembly module is hollow.

4. The method of claim 2, wherein at least a portion of the bottom hole assembly is hollow.

5. A method comprising:

securing a first module at an uphole end of the first module with a ram positioned below a barrier of a well to secure the first module within the well;

positioning a second module within a lubricator having a longitudinal length of up to 90 feet;

installing the lubricator, within which the second module is positioned, on the well;

after installing the lubricator, opening the barrier;

positioning the second module downhole through the open barrier;

coupling the uphole end of the first module to a downhole end of a second module to form a bottom hole assembly having a longitudinal length of greater than 100 feet, which is longer than the longitudinal length of the lubricator;

releasing, from the ram, the first module coupled to the second module; and securing, with the ram, the second module at an uphole end of the second module to secure, within the well, the bottom hole assembly.

6. The method of claim 5, wherein coupling the uphole end of the first module to the downhole end of the second module is accomplished independent of rotational movement of the first module and the second module.

7. The method of claim 5, further comprising:

coupling the first module to a setting tool;

positioning the first module within the lubricator;

installing the lubricator, within which the first module is positioned, on the well;

after installing the lubricator, opening the barrier;

positioning the first module downhole through the open barrier with the setting tool;

after securing the first module with the ram, decoupling the first module from the setting tool;

closing the barrier; and uninstalling the lubricator from the well.

8. The method of claim 7, further comprising:

coupling the second module to the setting tool, wherein the second module is positioned downhole through the open barrier with the setting tool; and after securing the second module with the ram, decoupling the second module from the setting tool.

* * * * *